US005098075A

United States Patent [19]

Lindblom

[11] Patent Number: 5,098,075

[45] Date of Patent: Mar. 24, 1992

[54] APPARATUS FOR ASSEMBLING AND DEPOSITING SIGNATURES

[75] Inventor: Kurt L. Lindblom, Trollhattan, Sweden

[73] Assignee: Miller-Johannisberg Druckmaschinen GmbH, Wiesbaden-Biebrich, Fed. Rep. of Germany

[21] Appl. No.: 447,572

[22] Filed: Dec. 7, 1989

[30] Foreign Application Priority Data

Feb. 23, 1989 [DE] Fed. Rep. of Germany ..... 3905558

[51] Int. Cl.[5] ..... B65H 39/02

[52] U.S. Cl. ..... 270/54; 270/60; 270/14

[58] Field of Search ..... 270/1-22, 270/37-48, 51, 52, 54, 58, 60

[56] References Cited

U.S. PATENT DOCUMENTS

| | | | |
|---|---|---|---|
| 4,026,537 | 5/1977 | Harris | 270/60 |
| 4,155,133 | 5/1979 | Timson | 270/54 |
| 4,925,173 | 5/1990 | Lindblom | 270/54 |

FOREIGN PATENT DOCUMENTS

| | | | |
|---|---|---|---|
| 2726406 | 9/1978 | Fed. Rep. of Germany | 270/54 |

*Primary Examiner*—Edward K. Look
*Assistant Examiner*—Therese M. Newholm
*Attorney, Agent, or Firm*—Carothers & Carothers

[57] ABSTRACT

An apparatus for assembling and depositing signatures and for laying one upon the other of two different or differently oriented partial inner books made up from the signatures thus assembled.

10 Claims, 18 Drawing Sheets

APPARATUS FOR ASSEMBLING AND DEPOSITING SIGNATURES

BACKGROUND OF THE INVENTION

Figure 1:
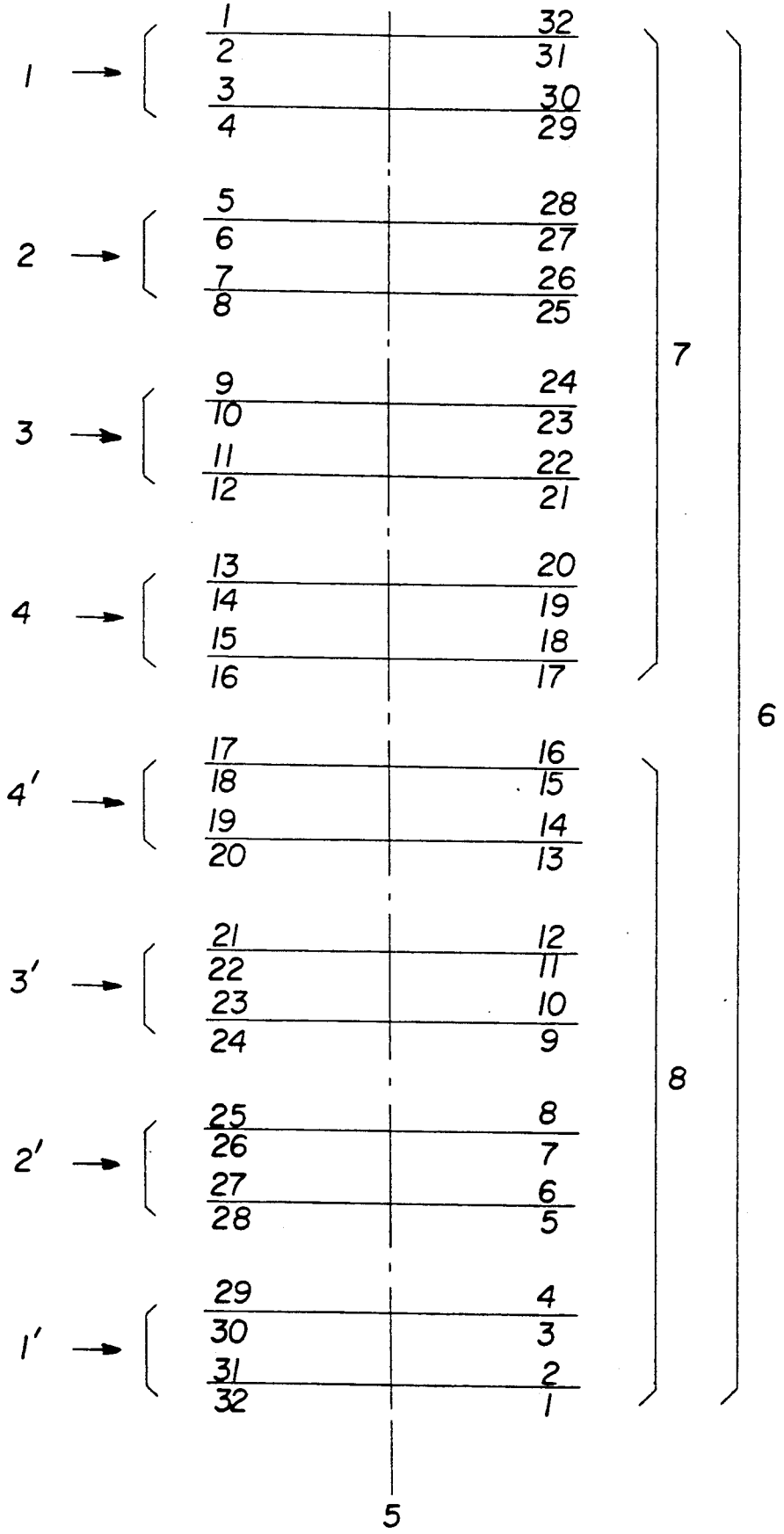

This invention relates to an apparatus for assembling signatures such as book signatures, which are transversely cut from a continuous band, into partial inner books, and for depositing the inner partial books assembled from the signatures. The apparatus is operative for laying two different or differently oriented ones of such partial inner books alternately one upon the other.

I have previously developed apparatus for assembling and depositing signatures in which signatures can be assembled in input compartments formed between the generally radially projecting vanes of an impeller wheel that is driven synchronically with the signature assembly cycle. The assembled signatures can then be ejected from the impeller wheel compartments onto a removal means. In my previously developed apparatus, the impeller wheel vanes are mounted for pivoting movement about respective axes that extend parallel to the impeller wheel axis. During regular rotary movement of the impeller wheel, the independent pivoting of the vane associated with the compartment to be loaded is controllable to provide a phase of relatively slow vane pivoting movement to extend the time during which the vane resides in the assembly angle region, and subsequently to provide a phase of quicker vane pivotal movement to move the vane more quickly to the output position, followed by return of the vane to the initial input position.

By means of such an apparatus, it is possible only to assemble signatures and deposit them identically. However, in the case of many book printing operations, tow differently oriented partial inner books are made up from an assembly of signatures, half of the partial inner books being inverted with respect to the remainder, and a pair of the relatively inverted partial inner books are laid one upon the other in order to form a complete inner book comprised of multiple complete sets of collated book pages, two sets for example, which then may be cut apart. A longitudinal cut across the pair of relatively inverted partial inner books thus produces two complete inner books.

For this sort of book printing operation, it has been necessary to provide special purpose inverting devices such as that disclosed in U.S. Pat. No. 4,858,904, to be arranged in conjunction with the signature assembly device. This generally entails considerable additional construction and equipment costs for the installation and, in all events, additional space requirements.

BRIEF SUMMARY OF THE INVENTION

This invention relates to an apparatus for assembling partial inner books and for inverting some of the partial inner books and assembling them with the non-inverted partial inner books to form complete inner books. In order to obviate the otherwise necessary provision of a separate inverting apparatus to accomplish this, the apparatus according to this invention is provided with two identical impeller wheels which rotate at a common rotary speed but in counter-rotary directions with respect to each other on horizontally spaced, parallel axes. Input compartments of each impeller wheel move from the releasing point of the signatures toward the input position and then toward a position between the two impeller wheels directly over a signature removal means. As they rotate, the input compartments of both the impeller wheels are displaced circumferentially relative to one another such that in the regions where they are facing or confronting one another each vane of the one impeller wheel is positioned approximately at the circumferential center of an input compartment of the other impeller wheel.

The apparatus of this invention also contemplates a selectively adjustable tongue which functions as a direction changer beyond a transverse cutting device that cuts individual signatures from a continuous band. By movement of the tongue to one of two operative positions, the signatures are selectively fed to one of two double belt conveyor means, each of which leads to the input position of one of the two respective impeller wheels. The adjustable tongue is switched over synchronically with the assembly cycle from one position to the other to direct a plurality of signatures to one impeller wheel to form a partial inner book, and then direct an identical plurality of signatures to the other impeller wheel to form a second partial inner book.

The removal means extends between the two impeller wheels and parallel to their rotational axes, and remains stationary while the impeller wheels rotate to alternately deposit their assembled signatures in relatively inverted orientation on the removal means.

The invention thus greatly simplifies the signature assembly and depositing aspect of this and similar printing operations, and it is therefore one object of the invention to provide a signature assembly apparatus which is operative not only to lay one upon the other of two different, that is, inverted relative to one another, partial inner books, but additionally to perform the requisite inverting operation on the partial inner books.

Figure 2:
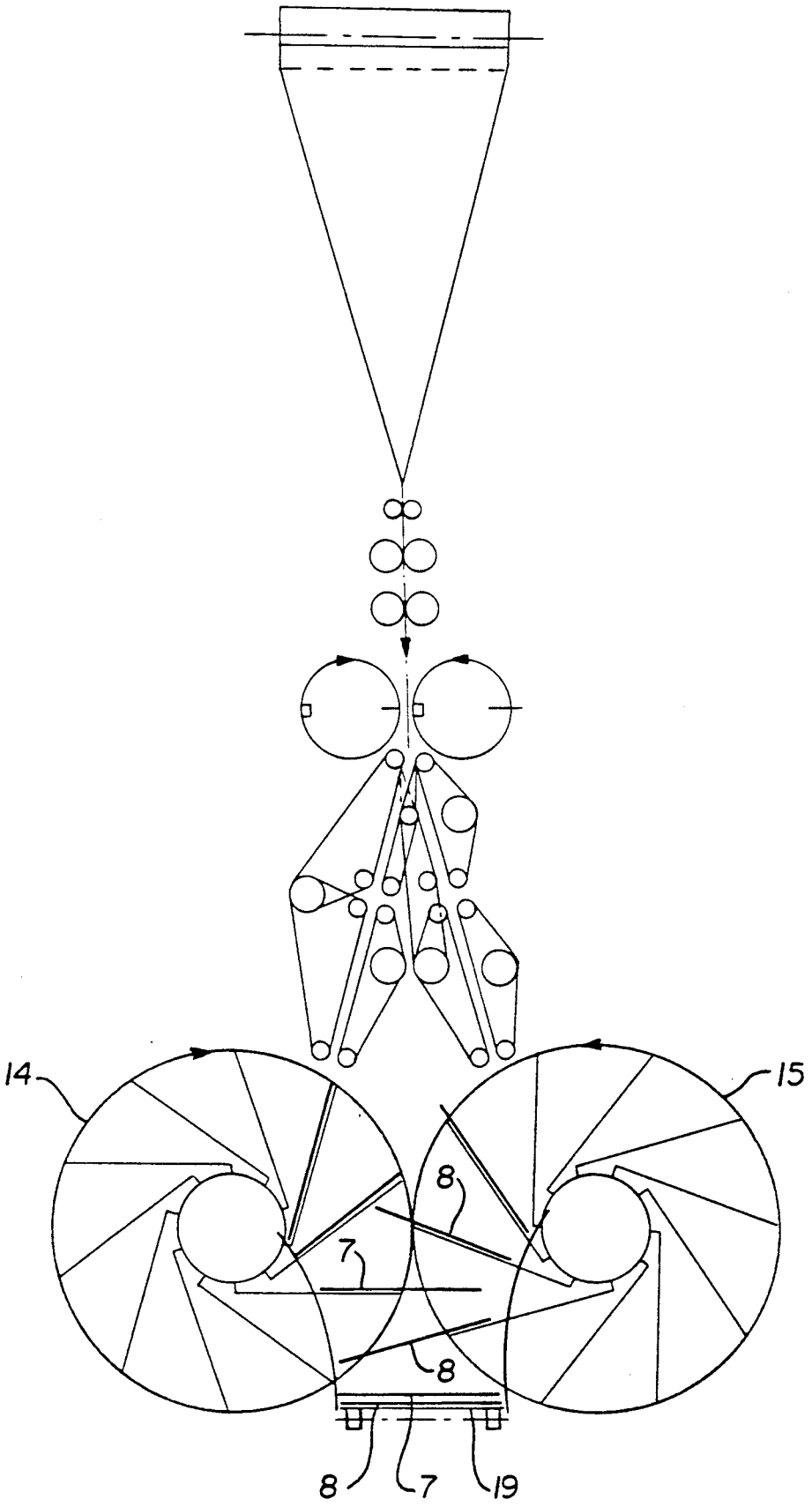

The invention is more particularly described hereinbelow with reference to the accompanying drawings, in which:

FIG. 1 shows a complete inner book as is to be produced by means of the apparatus according to this invention, the inner book being comprised of an assembly of signatures to form partial inner books or the like which are inverted in alternating fashion, and the subsequent laying one upon the other of pairs of relatively inverted partial inner books;

FIG. 2 shows a side elevational view of the invention and the mode of operation thereof according to one presently preferred embodiment during alternate laying one upon the other of inverted and non-inverted partial inner books on a removal means; and FIGS. 3 to 18 show the apparatus of FIG. 2 in the same elevational view, with each successive figure showing the apparatus at a point in the operating cycle incrementally later than the point in the cycle shown in the preceding figure, these figures taken together showing the entire apparatus operating cycle for production of a complete inner book from empty running-in of the apparatus through to depositing of the complete inner book on the removal means.

For purposes of this invention, two identical impeller wheels are provided which are rotatable on parallel, horizontally extending axes that lie adjacent to one another and are arranged symmetrically about a vertical central plane that is generally coincident with the path in which the signatures are guided downwards in a continuous band for release after leaving a transverse cutting device. As noted, the impeller wheels have their central axes extending parallel to one another and are driven at the same rotational speed but in mutually opposed rotary directions such that the input compartments of the respective impeller wheels move from the releasing point of the signatures first toward the input position and then toward a position between the two impeller wheels directly over the removal means. The removal means extends between the two impeller wheels and serves to remove deposited partial inner books in a direction preferably parallel to the rotational axes of the two impeller wheels, but is stationary during the signature depositing process.

The input compartments of the two impeller wheels are displaced circumferentially relative to one another in the regions where they are facing each other such that each vane of one impeller wheel protrudes or is positioned, viewed in the circumferential direction, approximately in the circumferential center of an input compartment of the other impeller wheel.

An adjustable tongue is provided as a direction changer beyond the transverse cutting device, through which tongue the signatures are selectively directed to one of two double belt conveyor means, each of which leads to the initial input position where resides an input compartment of one of the two impeller wheels. The adjustable tongue is switched over synchronically with the signature assembly cycle from its one position to its other position to provide for assembly of partial inner books alternately in successive compartments of the respective impeller wheels.

When it is desired to operate the apparatus of this invention only as a simple assembly apparatus without inverting some partial inner books with respect to others, then the adjustable tongue remains fixed in position and only one impeller wheel is supplied with signatures. This impeller wheel deposits partial inner books one after the other in identical orientation or position on the removal means. This mode of operation is therefore identical with that of known apparatus. When however it is desired to lay different or differently oriented partial inner books one upon the other, then the adjustable tongue acts as a direction changer and is switched over synchronically with the assembly cycle, so that each time a first group of signatures is assembled in one impeller wheel compartment, another group of signatures is then assembled in a compartment of the other impeller wheel. Accordingly, each time a partial inner book assembled in one impeller wheel is deposited on the removal means, another partial inner book from the other impeller wheel is laid upon the first partial inner book. Due to the counter rotating motion of the impeller wheels, the assembled partial inner books deposited on the removal means by one impeller wheel will be inverted with respect to those deposited by the other impeller wheel. Accordingly, on the removal means there will be a complete inner book made up of two different or differently oriented partial inner books which may, for example, be advantageously arranged to contain all of the pages of a book twice, positioned adjacent to one another, and in the correct page order as shown in FIG. 1, so that through a longitudinal cut two complete inner books may be produced.

It will be appreciated that the addition of a second impeller wheel formed identically to a first one, the incorporation of a tongue serving as a direction changer, and the modified construction of the removal means entail no large extra costs, and at all events any resultant extra costs, particularly also in regards to the cost of space, are considerably less than those which would be incurred by the provision of a separate, special inverting device for the laying one upon the other of two consecutive partial inner books in different orientations.

The apparatus according to the invention is expediently constructed such that the two double belt conveyor means each comprise two belt pairs following one pair on the other, the upper of which moves faster than the continuous band of signatures, while the second or lower belt pair moves substantially more slowly, for example at approximately half the speed of the upper belt pair, so that between the two belt pairs a slowing down of the signature travel speed and an overlapping of the succession of signatures is achieved. The somewhat faster running of each upper belt pair has the purpose of creating small separating gaps between the signatures after cutting thereof from the continuous band of signatures. These gaps accommodate the switching over of the direction changing tongue. The slowing down of the signatures by each lower belt pair serves two purposes. First, the overlapping of the consecutive signatures facilitates their introduction into and sliding into the input compartments of the impeller wheels, as in this manner they can slide downwards without interruption rather as from an inclined plane. Secondly, the slowing down of signature travel has the advantage for signatures coming up very fast from modern, very rapidly operating book printing machines, that they impact with substantially less force against the inner side of the impeller wheel input compartments, thus greatly diminishing the risk of damage to the signatures.

A guide means is expediently provided between the output position of each impeller wheel and the depositing position on the removal means on each side of the partial book pile in order to guide the partial books onto the removal means, thus achieving a precise transfer of the partial inner books as assembled in the impeller wheel compartments and also preventing the crumpling of individual signatures on their passage to the removal means.

Referring more specifically to the drawing, an exemplary arrangement of signatures as shown in FIG. 1 is made up as follows: first, each signature 1 through 4 is a single sheet folded once transversely, the fold line lying, with reference to the front view shown, behind the plane of the drawing; secondly, each signature comprises two different book page spans of four consecutive pages, each positioned adjacent to one another. Thus, when the stacking of a complete inner book 6 out of two partial inner books 7 and 8 has been accomplished and the inner book 6 is cut along cutting line 5, two complete books result.

As will be seen, a set of the different signatures 1 to 4 is first arranged in ascending order to form partial inner book 7 and then an additional set of the same signatures 1' to 4' is arranged in descending order as shown to form partial inner book 8. For illustrative purposes, the numbers of the pages on the individual sheets of each signatures are marked in FIG. 1 as vertical columns of numbers for pages 1 to 32 inclusive. Each signature therefore, as noted, comprises two sets of four pages and the completed book comprises 32 pages. That is, to the left of the cut line 5 the pages 1 to 32 are arranged consecutively from the top downwards whereas to the right of cut line 5 they are arranged consecutively from the bottom upwards. Two complete books consisting of pages 1 to 32 inclusive are therefore produced by the cutting along cut line 5.

Of course, the two layers of each individual signature are not positioned at a distance from each other as shown in FIG. 1 when they leave the book printing or folding device, but instead lie smooth and flat one upon the other so that during their further processing by the apparatus of this invention they can be handled as though they were a single sheet. The signatures are shown at a distance from one another in FIG. 1 only to clearly illustrate the page numbering sequence.

In the following description of FIGS. 2 to 18, the reference numerals are in general included in FIGS. 2 and 3, and also are included in all the other figures insofar as they are relevant to the description of those individual figures.

Figure 3:
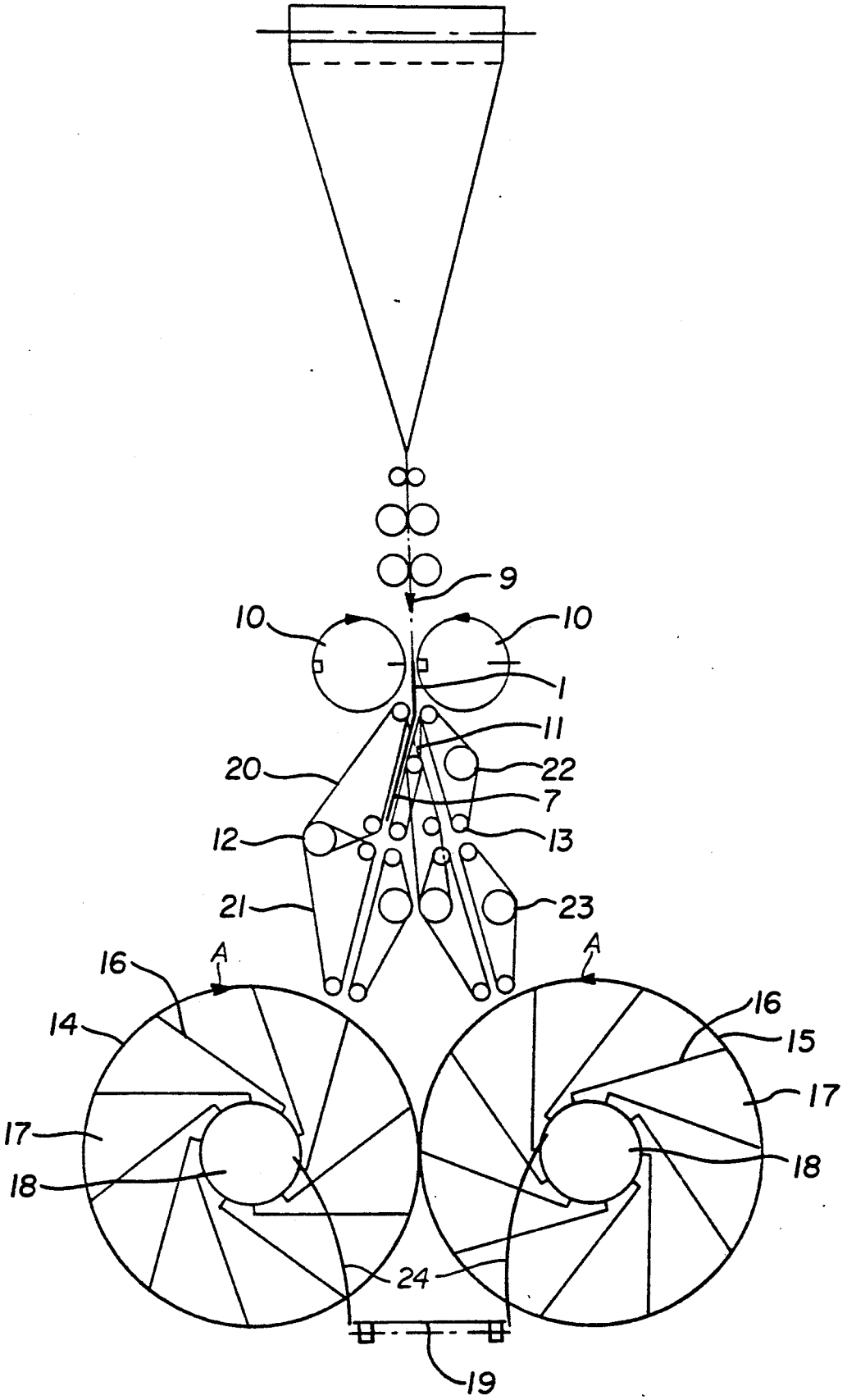

Referring to FIGS. 2 and 3, the oncoming signature band package 9 runs to a cutting device 10 where it is transversely cut into a sequence of the individual signatures 1 to 4, only the signature 1 being shown in FIG. 3. The transverse cutting device 10 is followed by a regulatable direction changing tongue 11, which is adapted to be switched over from one position to another after having passed a predetermined number of signatures to one side thereof. By means of this tongue 11, each signature is directed selectively to one of two double belt conveyor devices, the left hand one of which is designated as 12 and the right hand one as 13. The left hand double belt conveyor device 12 leads to an impeller wheel 14 on the left, and the right hand double belt conveyor device 13 leads to an impeller wheel 15 on the right. Each of the two impeller wheels 14 and 15 includes a plurality of circumferentially distributed vanes 16 which form corresponding input compartments 17, and in which compartments 17 the signatures 1 to 4 are assembled and out of which compartments the partial inner books 7 and 8 so formed can be ejected onto a removal means 19 as described below.

Vanes 16 are mounted to be pivotal about respective axes X which are parallel to the impeller wheel axis at the center of a hub 18 of each impeller wheel 14 and 15. Accordingly, during regular rotary movement of the hub 18 the corresponding rotary movement of the vane 16 associated with the compartment 17 to be loaded is controllable periodically in the assembly cycle to include a phase of slow rotary movement while located in the assembly angle region followed by a phase of quicker rotary movement to the output position and back again to the initial input position. Suitable cam levers and cooperating structure may be utilized to provide this controlled movement of vanes 16.

Also as shown in FIGS. 2 and 3, the two identical impeller wheels 14 and 15 are symmetrically positioned with respect to a central vertical plane at horizontally spaced locations and adjacent to one another, and with their central axes of rotation extending parallel to one another. The impeller wheels 14 and 15 are driven at the same rotary speed but in mutually opposed directions of revolution, as indicated with arrows A in FIG. 3 for example, such that the input compartments 17 move from the releasing position of the signatures first toward the input position adjacent the respective belt conveyers 12 and 13, and then toward a position between the two impeller wheels 14 and 15 and downwards toward the removal means 19.

The respective confronting input compartments 17 of the two impeller wheels 14 and 15 are displaced relative to one another in the circumferential direction such that, as is clearly evident from the figures, in the region where they are facing each other each vane 16 of one impeller wheel is positioned, viewed in the circumferential direction, approximately at the circumferential center of an input compartment 17 of the other impeller wheel.

The removal means 19 extends between the two impeller wheels 14 and 15 parallel to their rotational axes X and is adapted to be stationary during the depositing thereon of signatures from both of the impeller wheels 14 and 15.

Each of the two double belt conveyor devices 12 and 13 is comprised of two belt pairs following one upon the other, the upper pair of the double belt conveyor device 12 being designated as 20 and its corresponding lower belt pair as 21, while the upper belt pair of the right hand double belt conveyor device 13 is designated as 22 and its associated lower belt pair as 23. Both upper belt pairs 20 and 22 are run at a slightly higher speed than that of the oncoming continuous band of signatures 9 in order to produce gaps between the individual signatures after cutting thereof by cutter 10. During passage of the signatures downwardly, the switching over of the tongue 11 can take place without impediment by coordination of the tongue switch-over to occur when a gap between the successive signatures is properly positioned with respect to tongue 11.

The associated lower belt pairs 21 and 23 run substantially more slowly, at approximately half the speed of the respective upper belt pairs 20 and 22, for example, so that between the two belt pairs 20 and 21 on the one hand, and 22 and 23 on the other, an overlapping of the successive signatures one on another is produced as the oncoming signatures from belts 20 and 22 slow in their travel as they move onto the slower belts 21 and 23, respectively, thus closing the gaps between the successive signatures.

Between the output position of each impeller wheel 14 and 15, and the depositing position on the removal means 19, a permanent guide means 24 is provided on either side to guide the partial book piles for deposit thereof onto removal means 19.

The mode of operation of the invention as described is as follows. FIG. 2 shows in end result how partial inner books 7 and 8, coming alternately from the impeller wheels 14 and 15, are deposited on the removal means 19. Because these two kinds of partial inner books 7 and 8 are deposited on the removal means 19 by rotation downward from opposed sides, the one partial inner book 7 is inverted each time relative to the other partial inner book 8, and the other way around, with each partial inner book 7 being rotated with respect to partial inner books 8 through 180° about an imaginary axis extending parallel to the impeller wheel axes 18, is just being fed into the apparatus and, as the upper point of tongue 11 is pointing to the right, the signature 1 is being guided into the left hand double belt conveyor means 12 and thus toward the left hand impeller wheel 14. This first signature 1, shown in heavy continuous line, will later become the lowest or bottom signature 1 of the partial inner book 8 as shown in FIG. 1.

Figure 4:
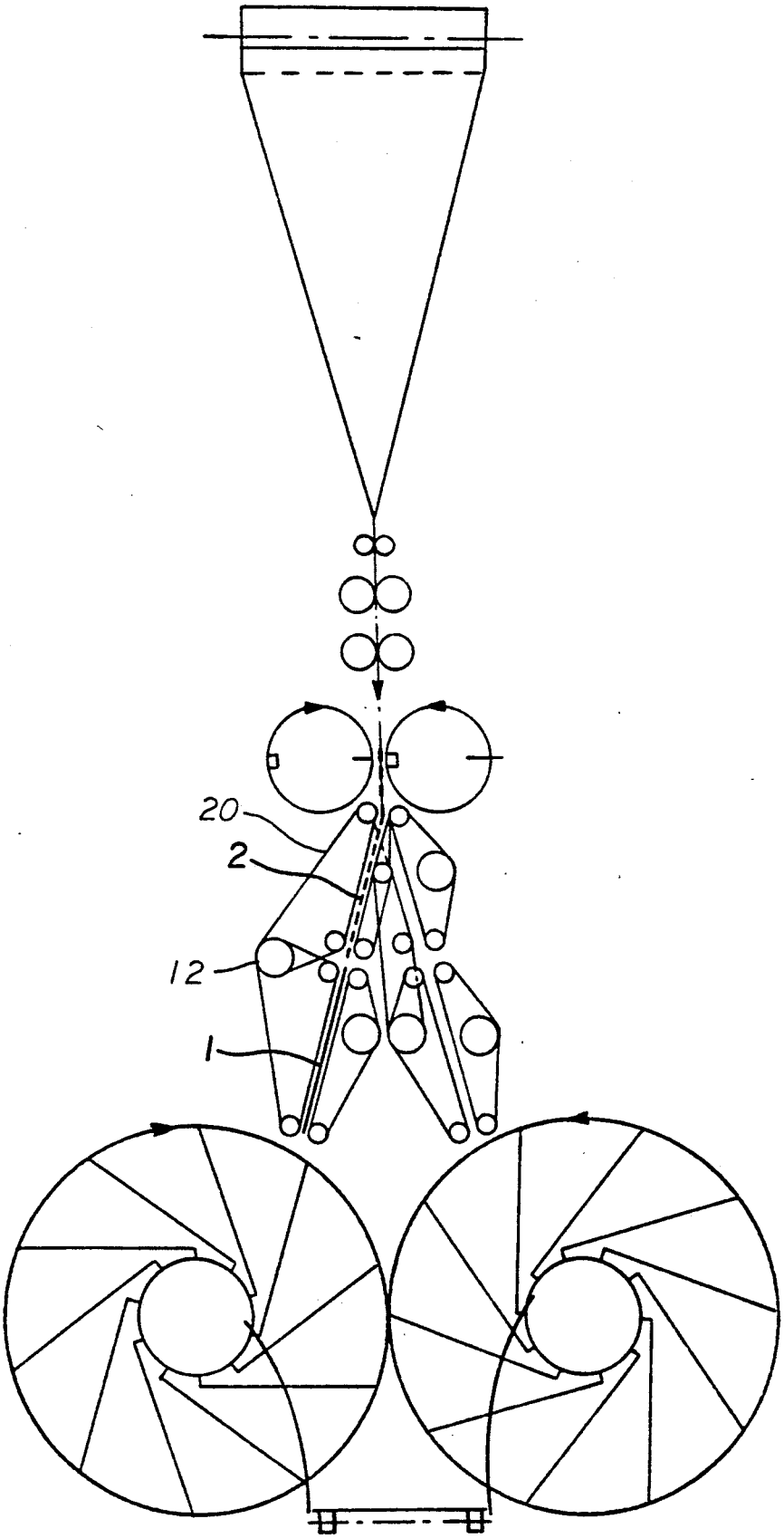

In FIG. 4 the first signature 1 has already approximately reached the lower end of the left hand double belt conveyor means 12 and the following signature 2 has reached the end of the upper belt pair 20 of the left hand double belt conveyor means 12. This second signature 2 is shown in heavy broken line, so: ----.

Figure 5:
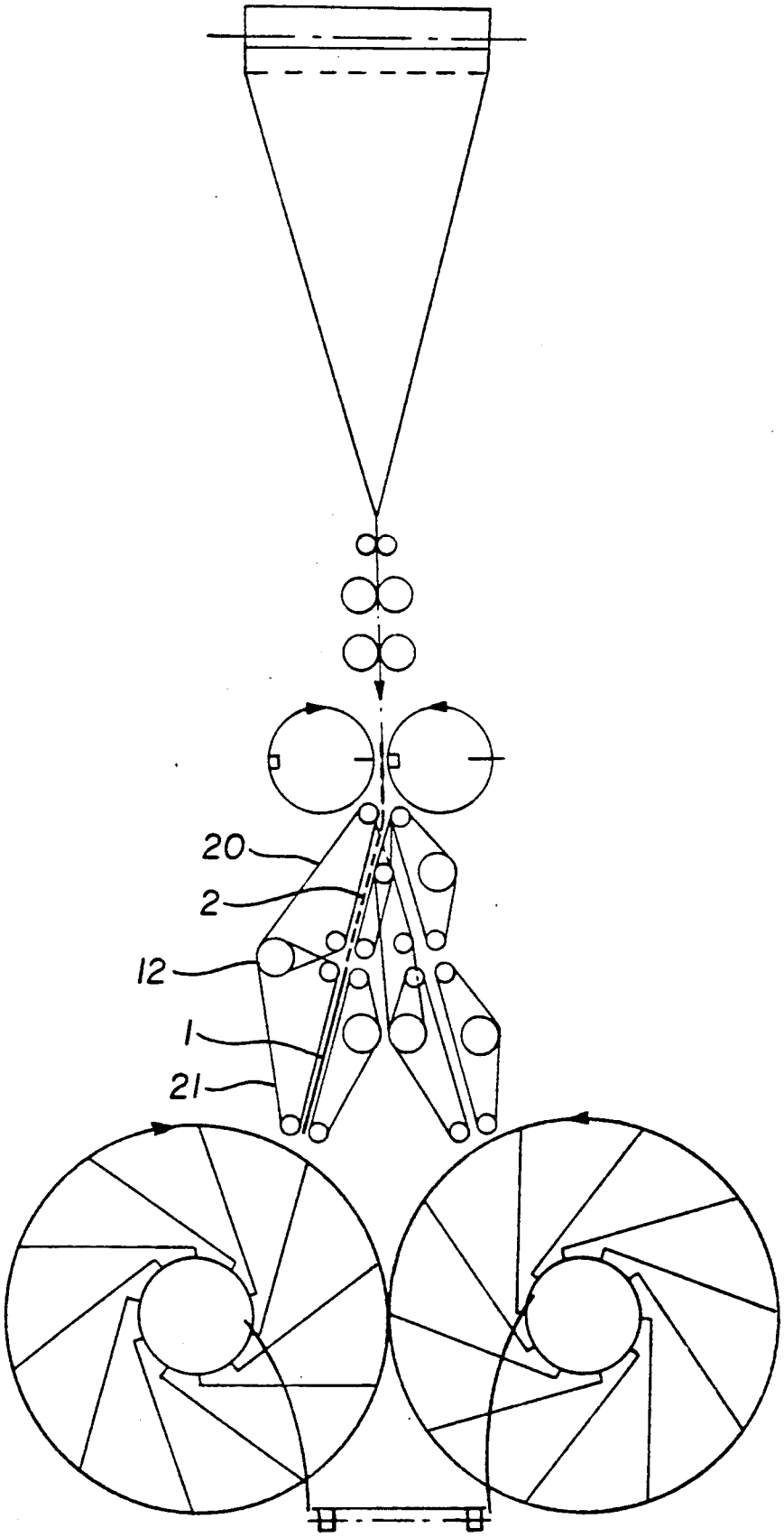

In FIG. 5, the first signature 1 has only proceeded a short distance further as the result of the substantially lower belt speed of the lower belt pair 21 of left hand double belt conveyor means 12, and the second signature 2 has moved in comparison considerably further such that at the crossover point between the upper belt pair and the lower belt pair 21 of the double belt conveyor means 12, the front edge of the signature 2 already overlaps slightly the rear edge of signature 1.

Figure 6:
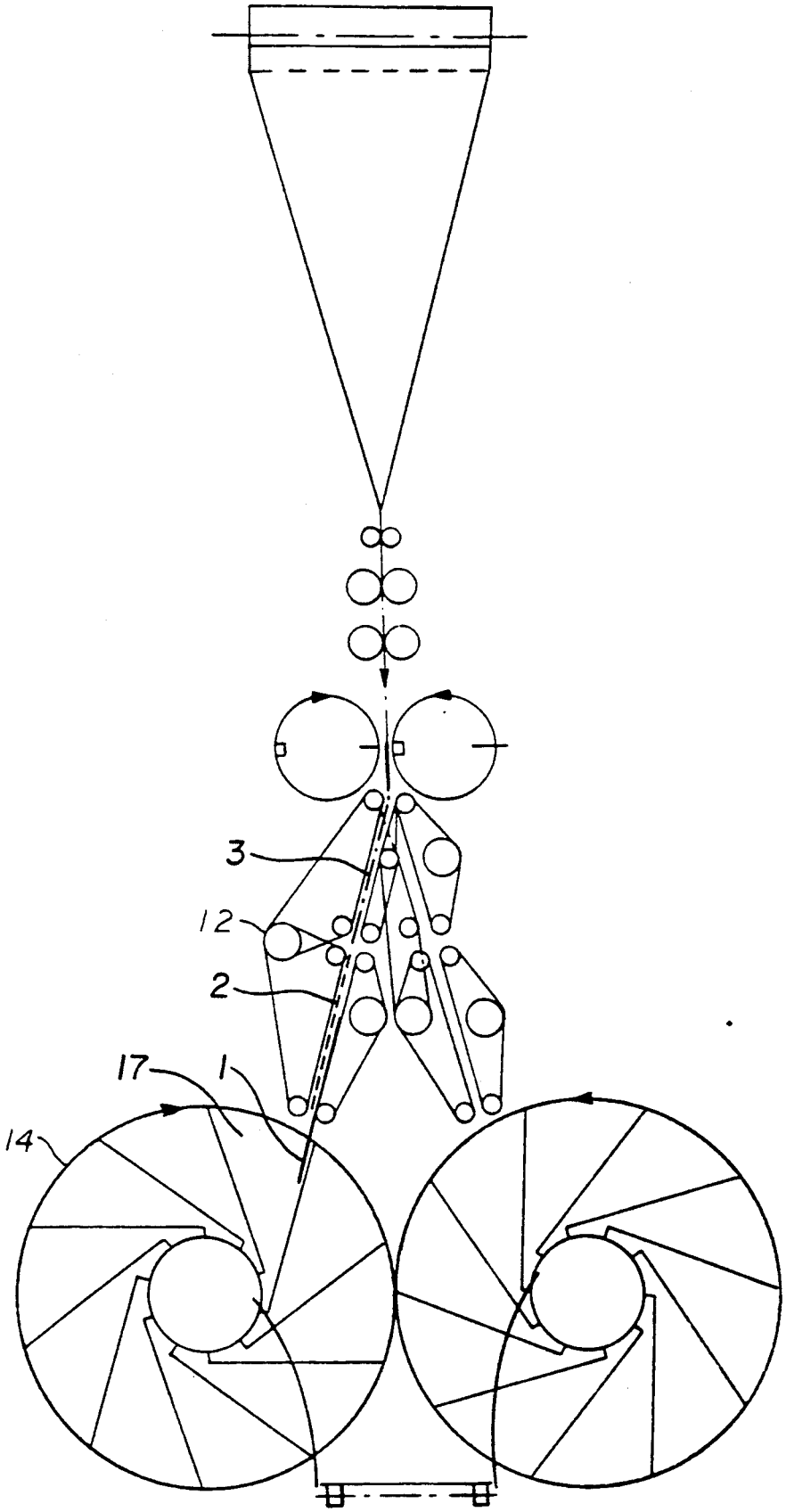

In FIG. 6, the second signature 2 has proceeded farther into lower belt conveyor 21 and overlaps the first signature by a substantially greater amount, and the first signature 1 is beginning to slide into the input compartment 17 of the left hand impeller wheel 14. The third signature 3, shown by the dash-stop-dash line thusly: -.-.-., is now in the upper belt pair of the left hand double belt conveyor means 12.

Figure 7:
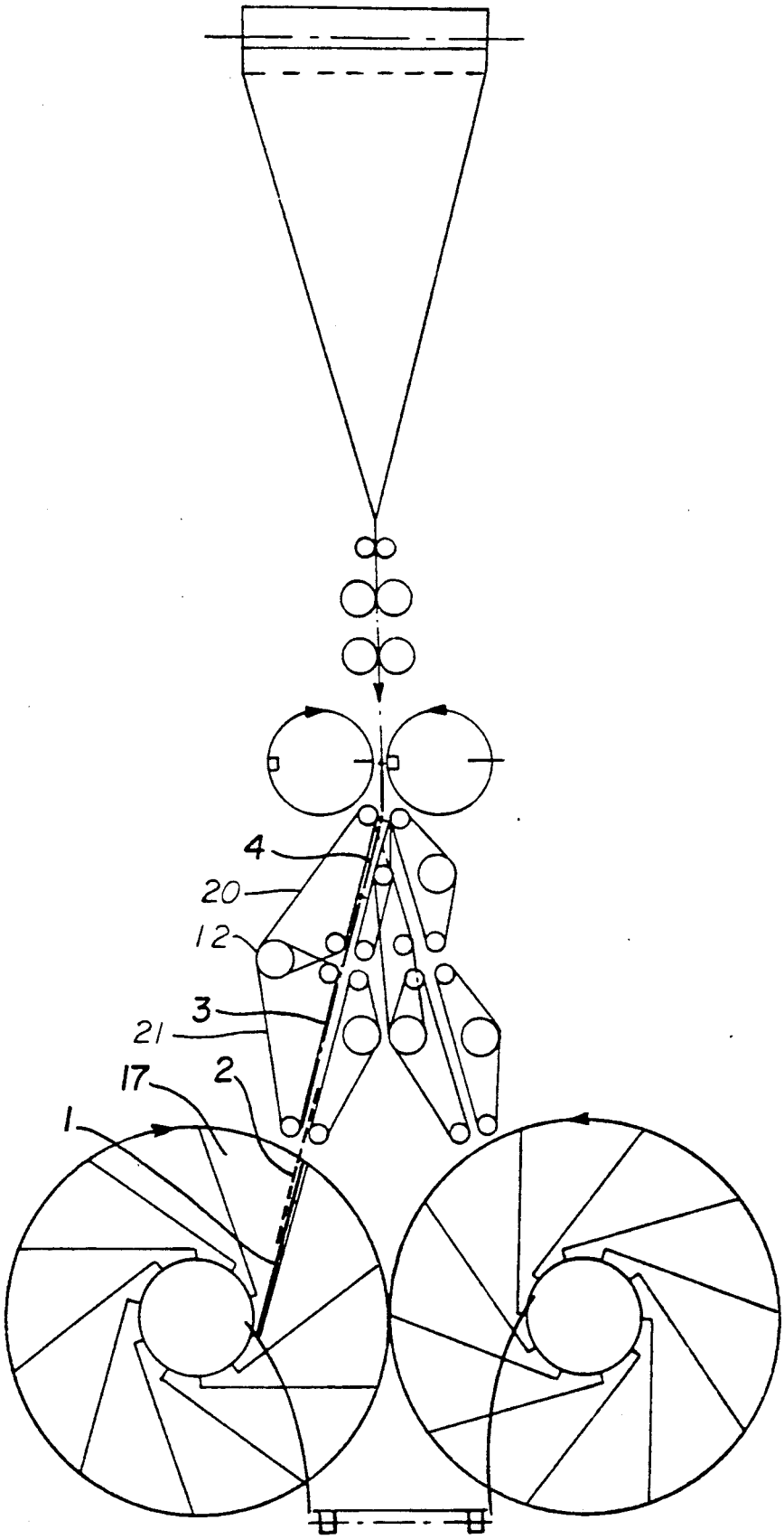

In FIG. 7, first signature 1 has entirely entered into input compartment 17 and second signature 2, carried along by its overlap with the first signature 1, is approximately half way into the compartment 17. The third signature 3 is in the lower belt pair 21 of left hand double belt conveyor means 12 and overlaps signature 2, and the fourth signature 4, shown by the line -x-x-x, is still in the upper belt pair 20.

Figure 8:
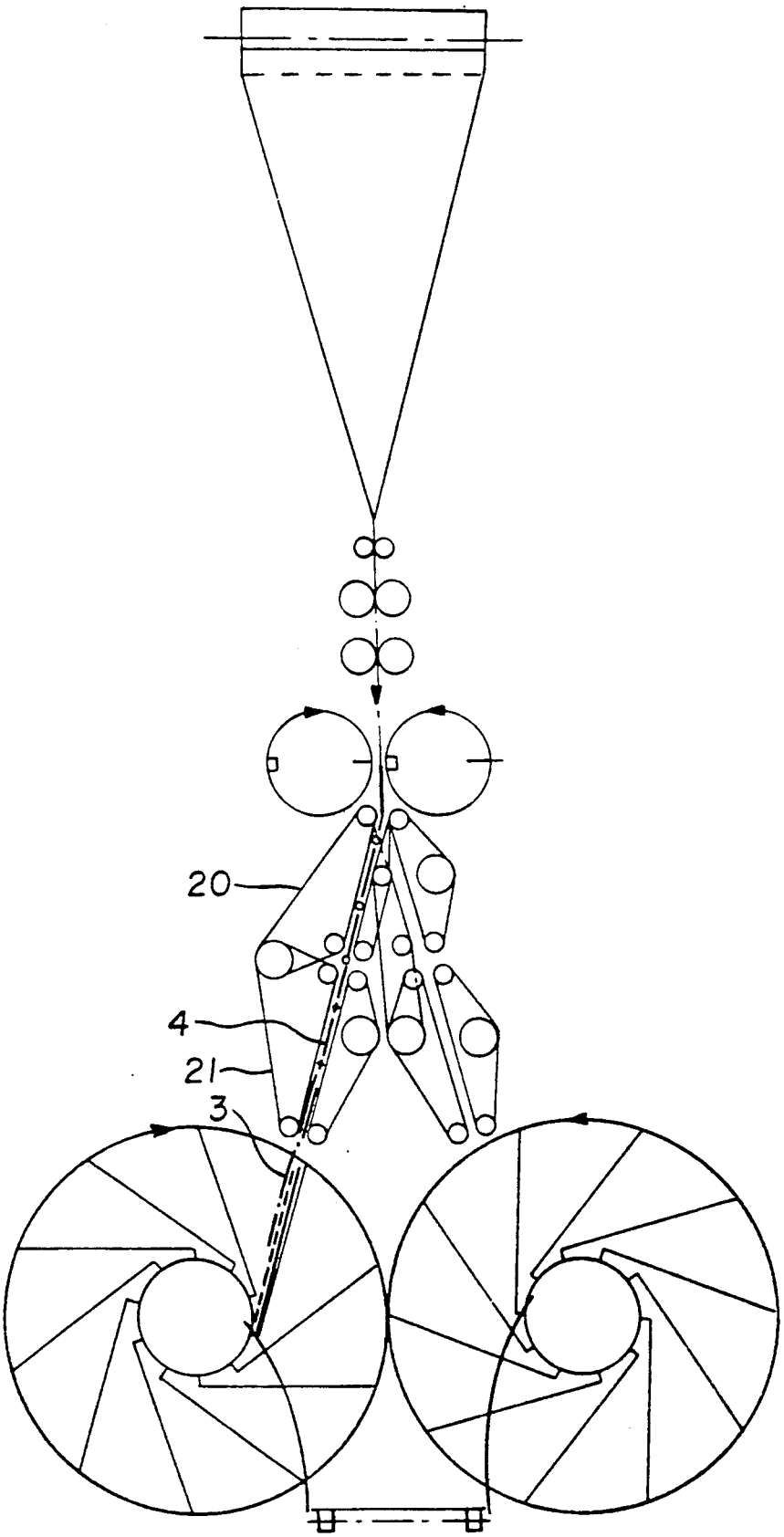

As shown in FIG. 8, an overlapping between signatures 3 and 4, which begins to occur at the crossover point between the upper belt pair 20 and the lower belt pair 21, has increased. The preceding signatures have also proceeded further by a corresponding and appropriate distance of travel.

Figure 9:
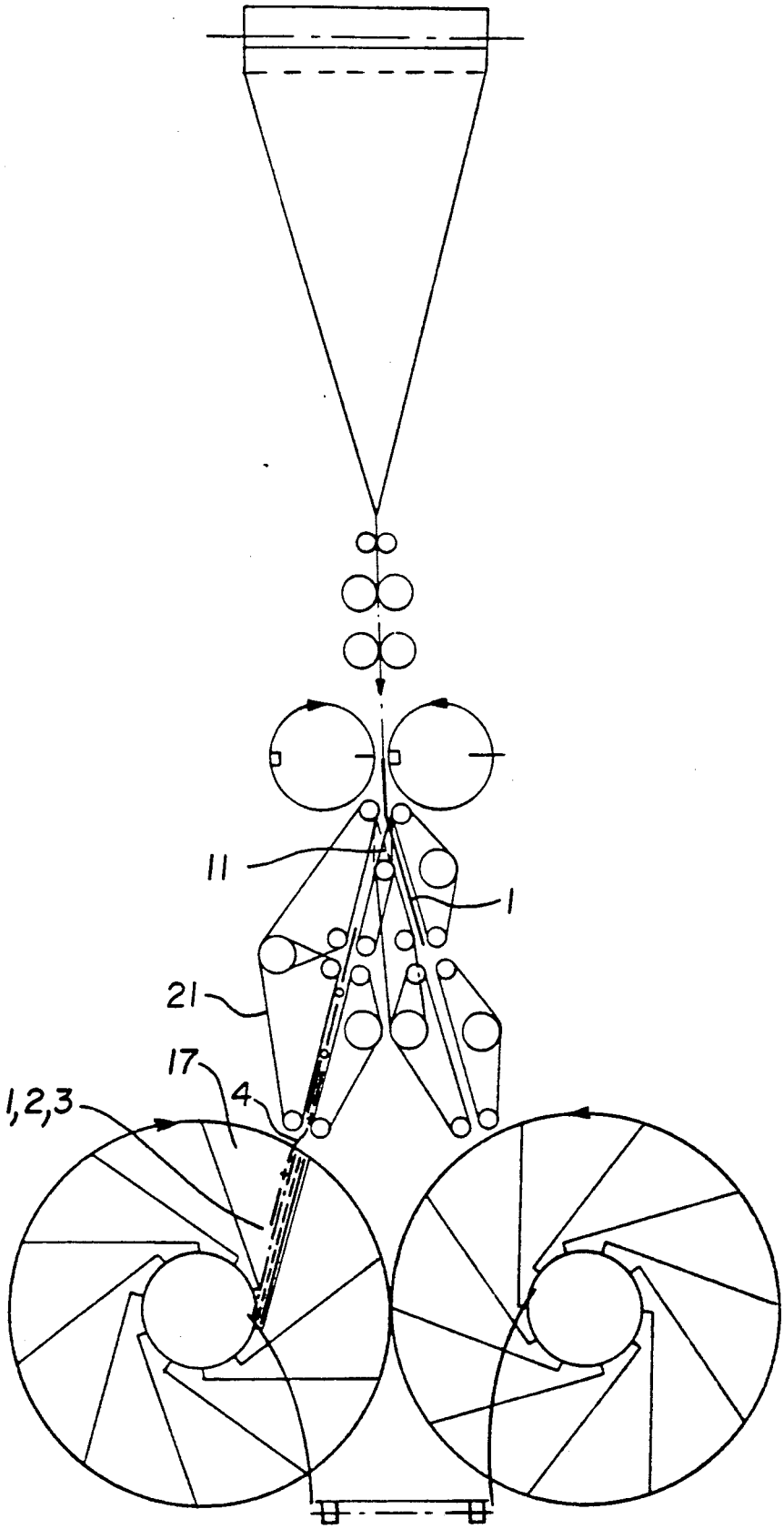
Figure 10:
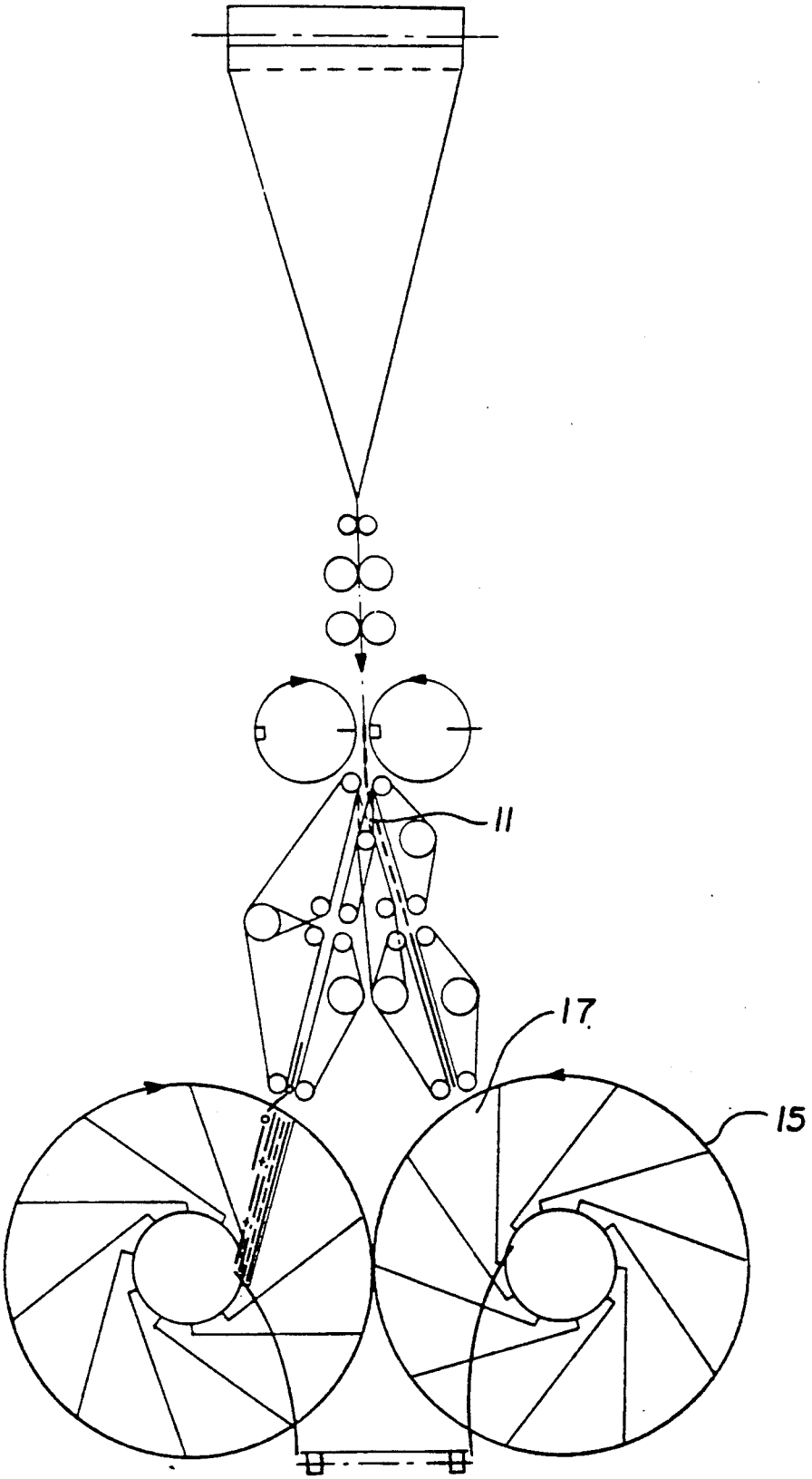

In FIG. 9, the signatures 1, 2 and 3 have been deposited in input compartment 17 and signature 4 is between the lower belt pair 21 in overlapping relation with signature 3, and is entering the compartment 17.

Upon complete entry of signature 4 into compartment 17, the partial inner book 8 will be completely made up from the four signatures 1 to 4 and will rest in input compartment 17 of the left hand impeller wheel 14. Substantially upon the passage of the trailing edge of signature 4 beyond tongue 11, the tongue 11 is switched over such that its upper end points toward the left, and exactly the same assembly procedure as described above will be repeated for the assembly of signatures 1 to 4 in an input compartment 17 of the right hand impeller wheel 15 as shown in FIGS. 9 to 14. The last signature is just on its way into the associated input compartment 17 of right hand impeller wheel 15 in FIG. 15.

Figure 11:
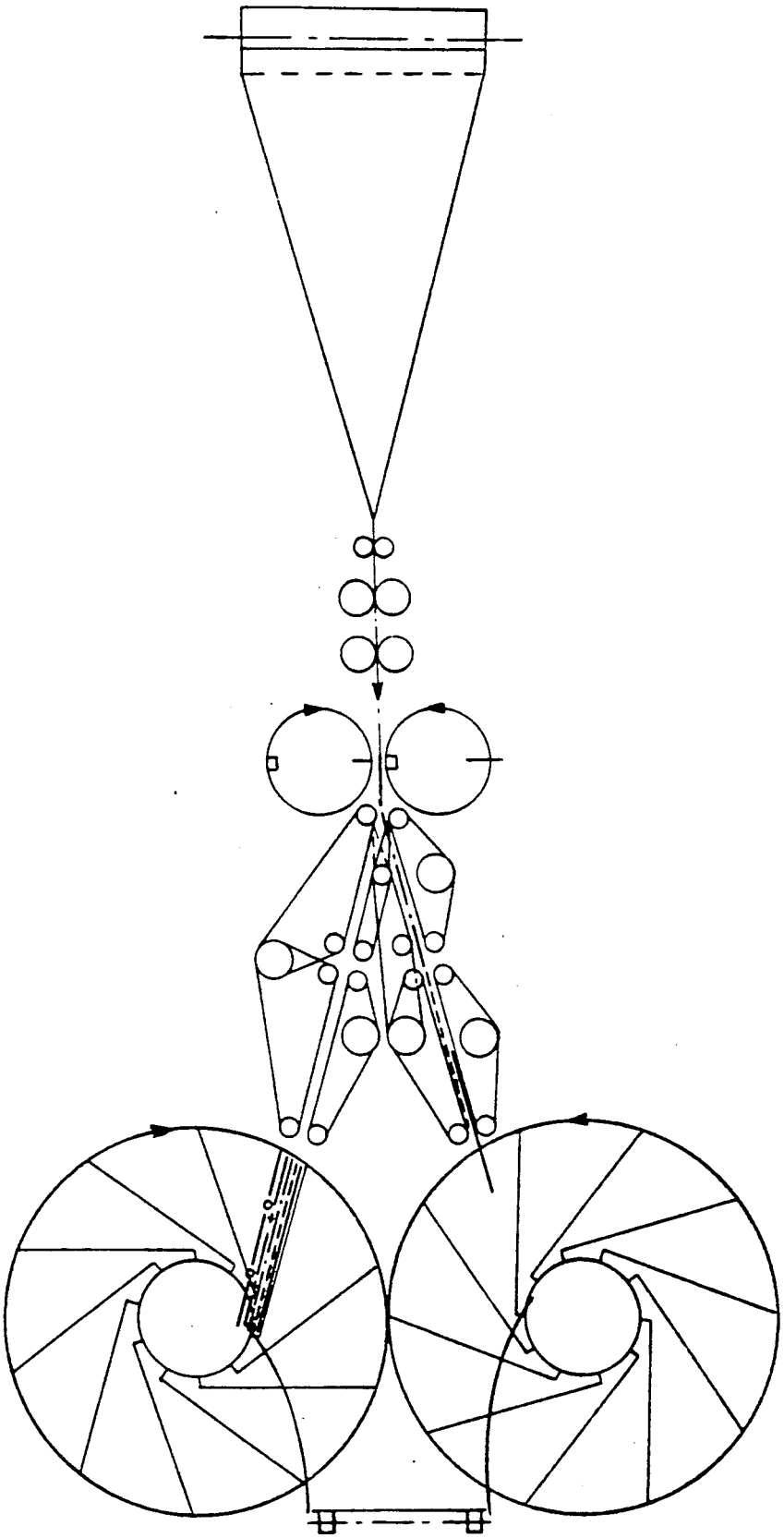
Figure 12:
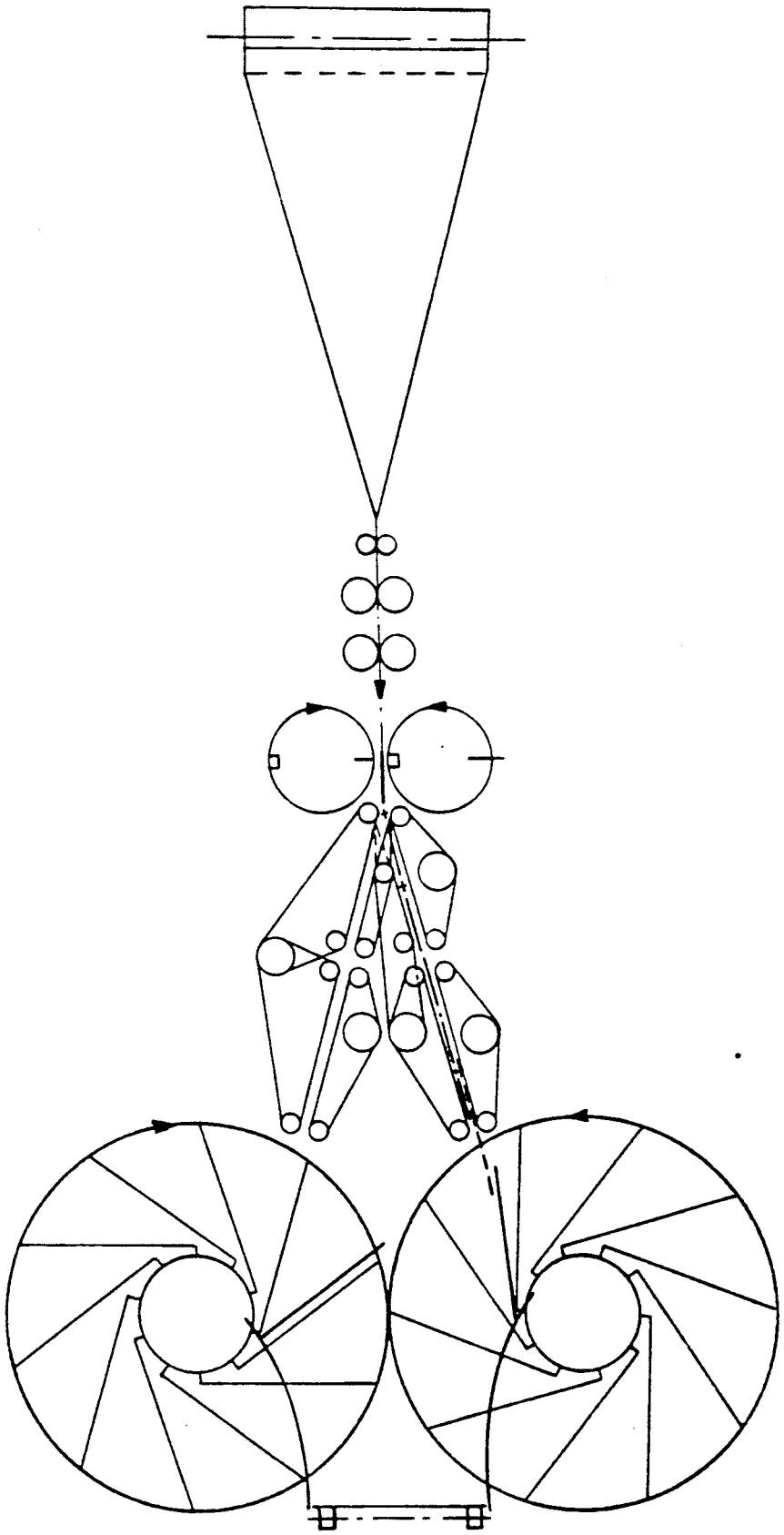
Figure 13:
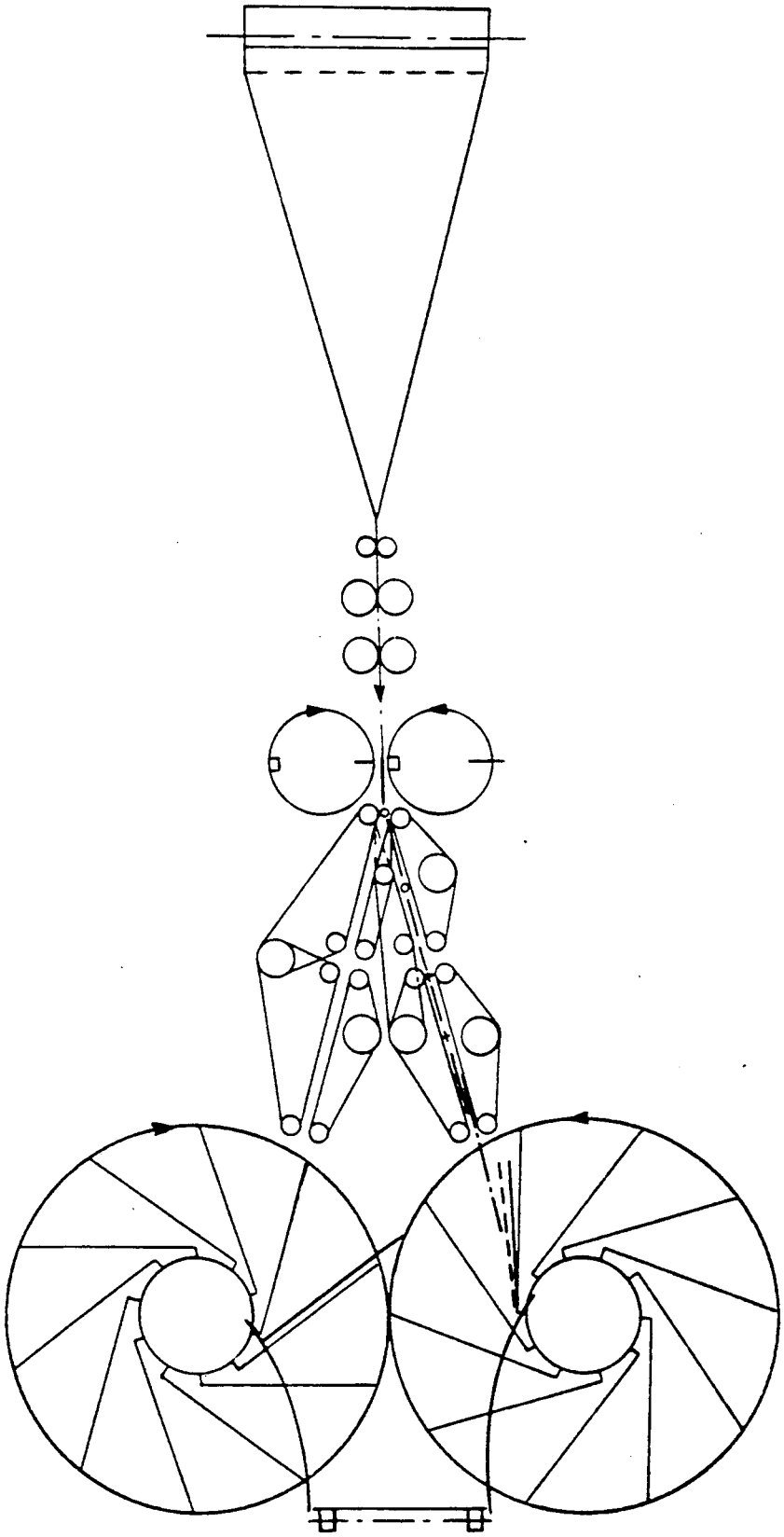
Figure 14:
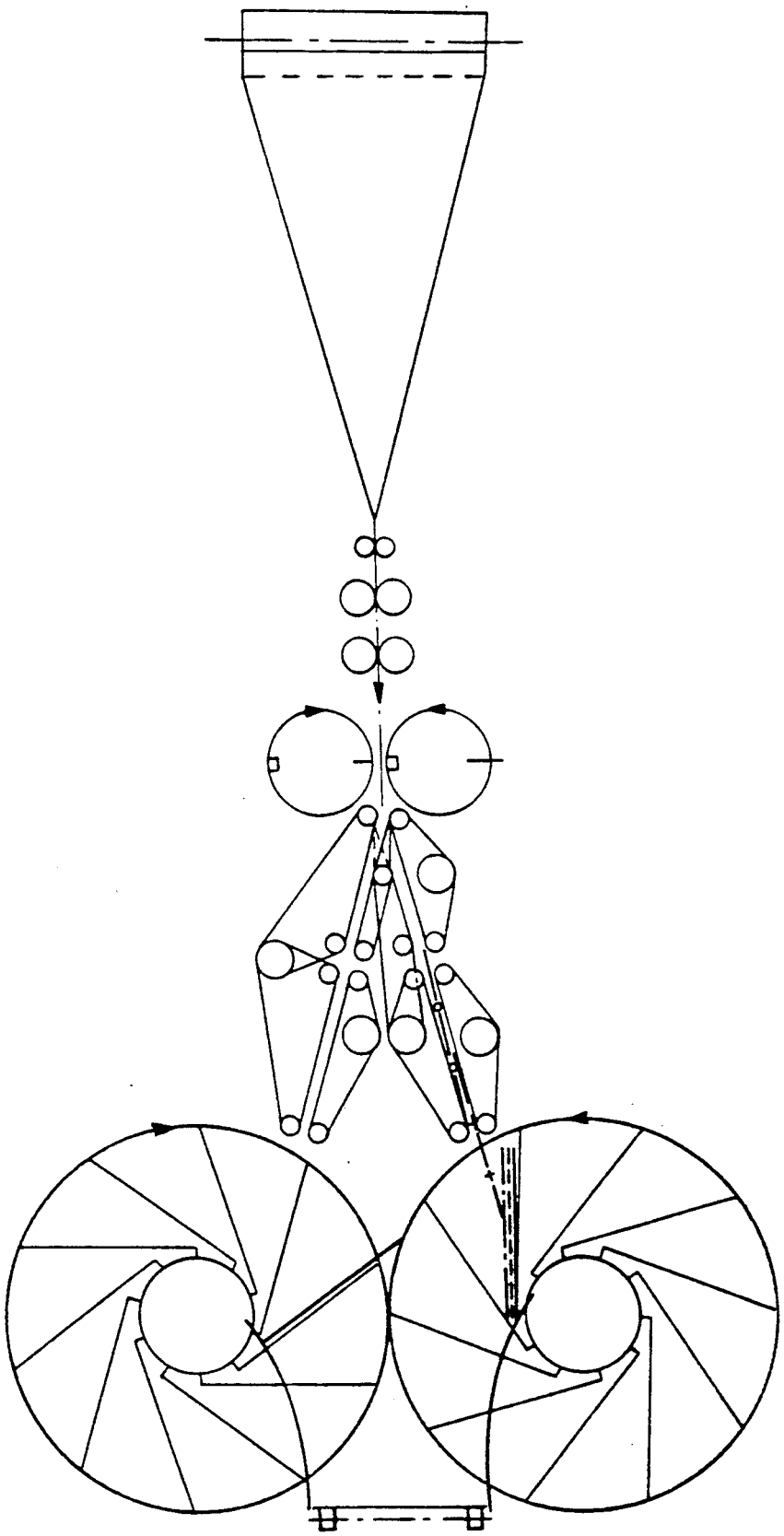

Some of FIGS. 8 through 18 show an additional or fifth signature thusly: -o-o-o, merely to clearly illustrate that the invention is not limited to processing of a particular fixed number of different signatures. Additionally, the assembly of signatures 1–4 together shown in FIG. 11 is shown in the succeeding figures as a heavy solid line. This is not to be confused with the heavy solid line depiction of signature 1 as in FIGS. 3 and 9, for example.

Figure 15:
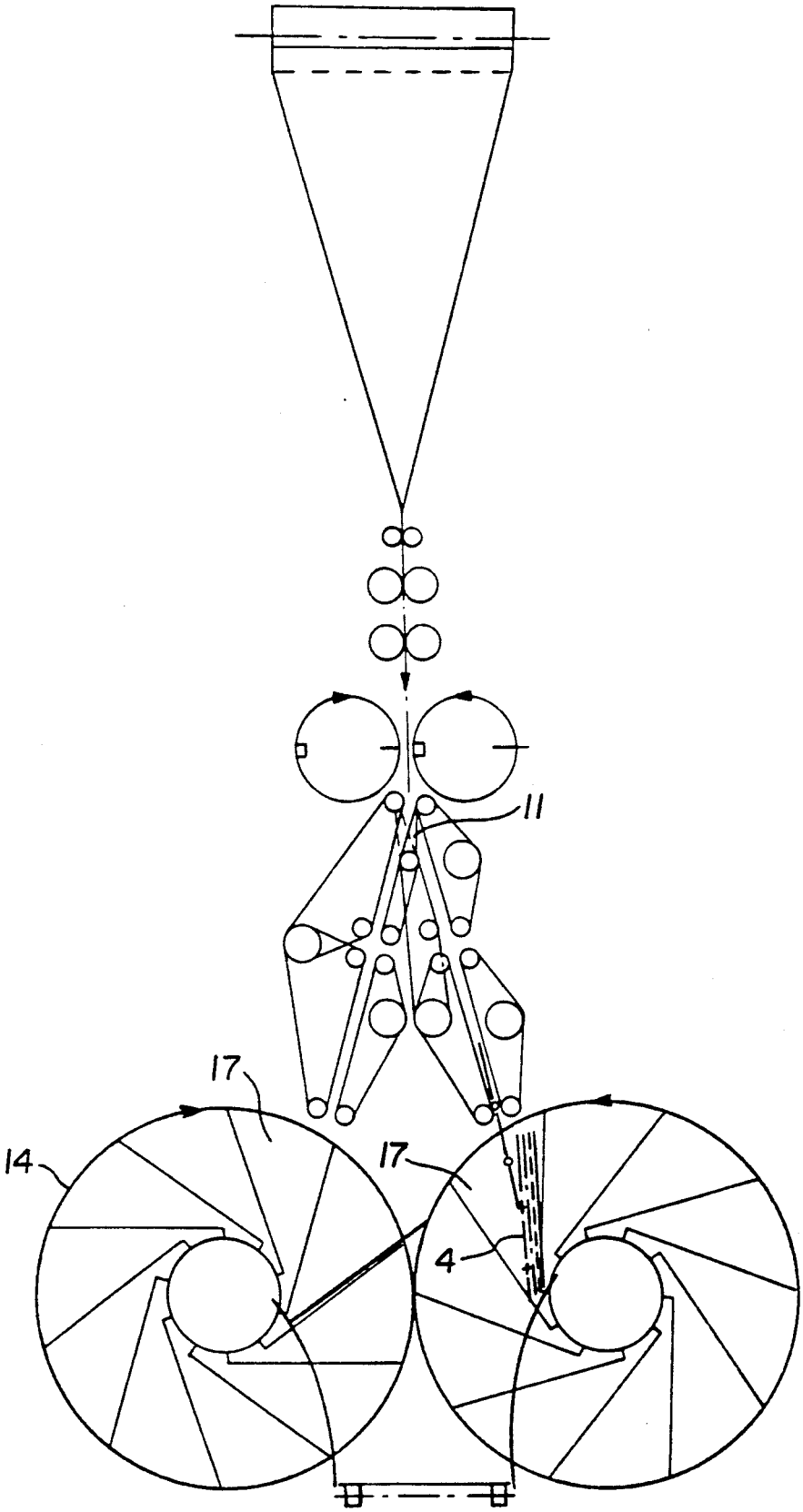
Figure 16:
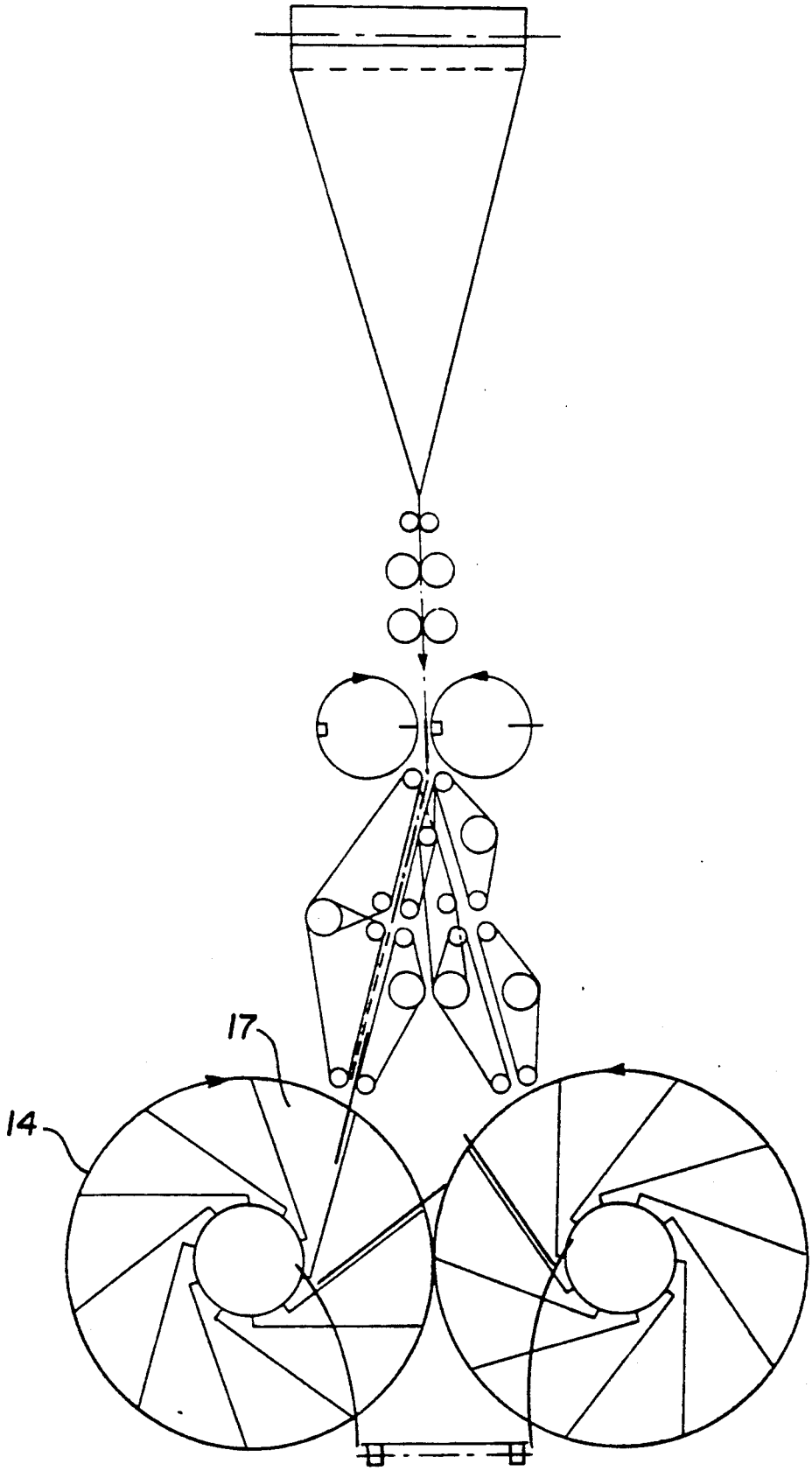
Figure 17:
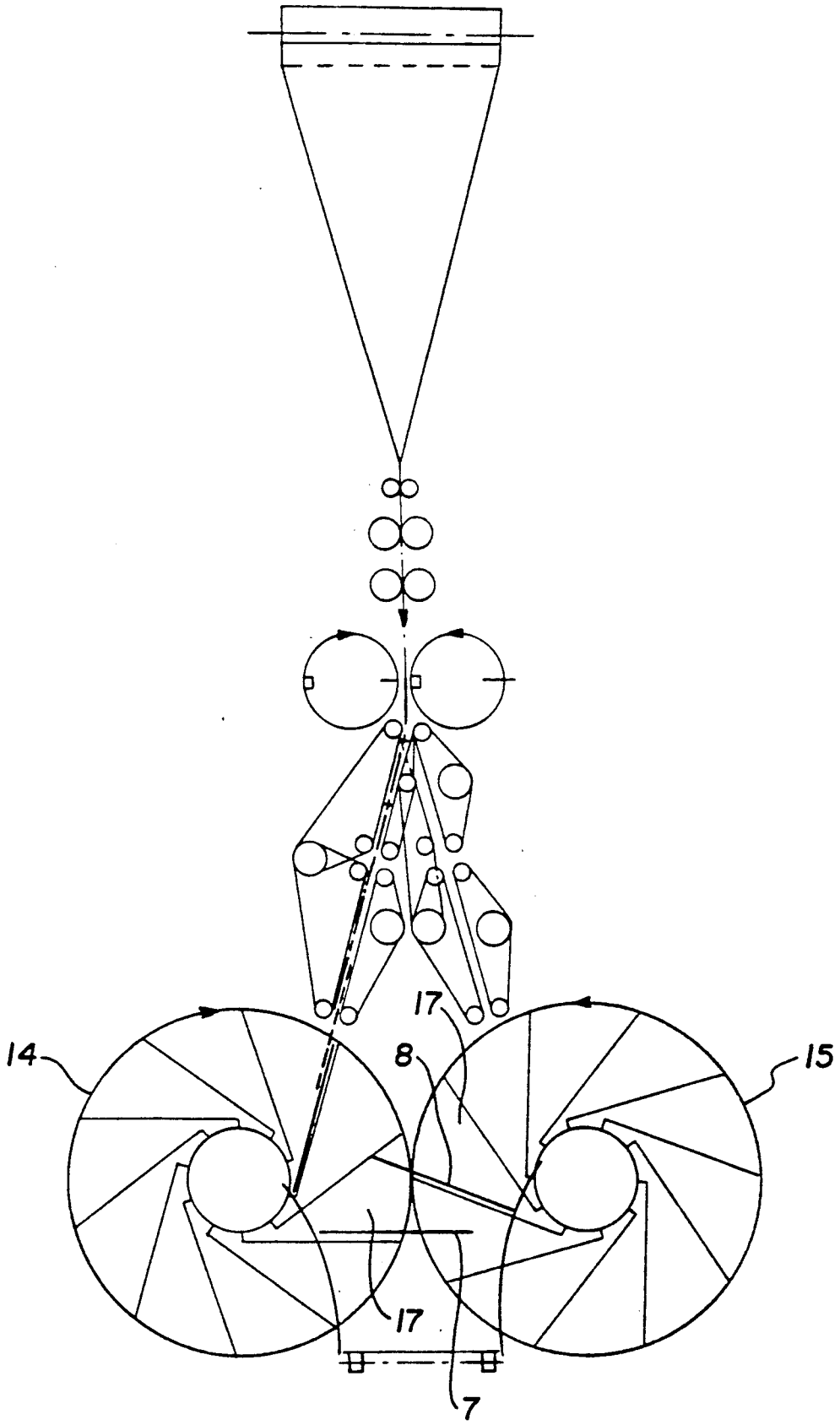
Figure 18:
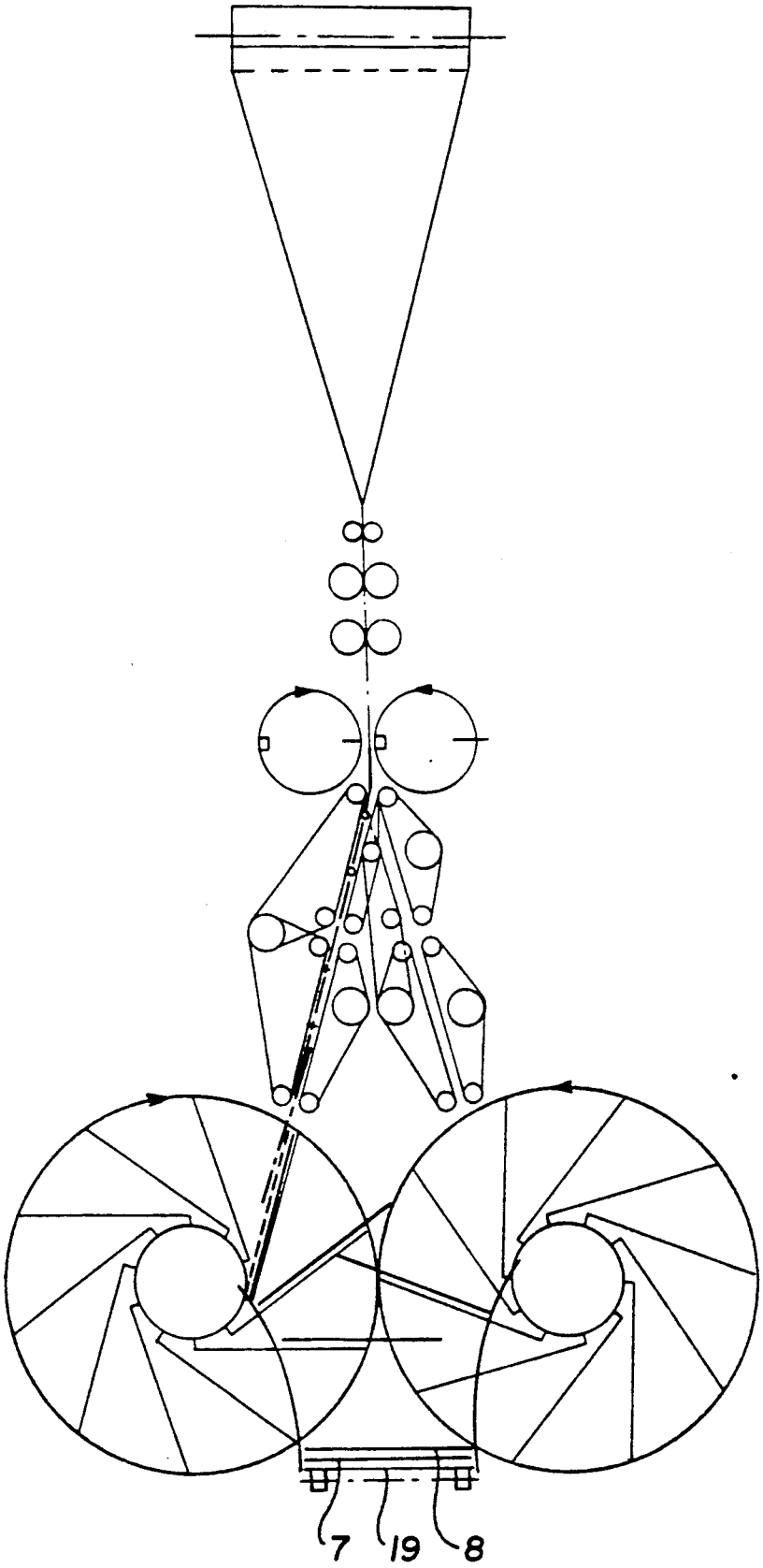

In FIG. 15, tongue 11 has been switched over again so that a renewed filling of the succeeding input compartment 17 of left hand impeller wheel 14 commences and proceeds as described hereinabove until FIG. 18. In the meantime, as shown in FIGS. 17 and 18, both impeller wheels 14 and 15 rotate together in the clockwise and anti-clockwise directions, respectively, each with filled input compartments 17 that proceed in alternating sequence as shown in FIG. 17 to the output position where the compartment contents are deposited onto the removal means 19. In this manner, two partial inner books 7 and 8 that are turned over by 180° (i.e. inverted) relative to one another, are deposited on the removal means 19 and then transported away thereon in a direction preferably perpendicular to the plane of the figures in order to make place for the depositing of the succeeding partial inner books 7 and 8.

The apparatus may naturally also be so operated such that at each time two or more partial inner books 7 are assembled in the left hand impeller wheel 14 and then deposited, and that only then are one or more partial inner books 8 assembled in the right hand impeller wheel 15 and deposited on the previously assembled partial inner book 7. That is, the essential character of my novel apparatus resides in its ability to invert assembled collections of signatures with respect to each other without regard to whether such inversion operation is carried out alternately or in some other desired mode on a sequence of signature assemblies.

The overlapping of the successive signatures 1 to 4 at the crossover point between the upper and lower belt pairs 20, 21 and 22, 23 of the left hand and right hand double belt conveyor means 12 and 13, respectively, may be facilitated and perfected by generally known means commonly employed for printing machines, for example known overlap feeders. Detailed description of such known overlap feeder is believed unnecessary for an understanding of the present invention.

Accordingly to the description hereinabove, I have invented a novel and improved apparatus for assembling and depositing signatures to form complete inner book or the like from partial inner books comprised of such assemblies of signatures which are differently oriented (i.e. inverted) with respect to one another and then combined to form the complete inner books or the like. Of course, I have contemplated various alternative and modified embodiments apart from those described hereinabove, and such alternatives surely would also occur to others versed in the art, once apprised of my invention. Accordingly, it is my intent that the invention be construed broadly and limited only by the scope of the claims appended hereto.

I claim:

1. An apparatus for assembling a plurality of signatures into partial inner books and for depositing such partial inner books comprising:

a pair of impeller wheels disposed adjacent one another and rotatable about respective axes of rotation in counter-revolutionary fashion with respect to one another;

each of said impeller wheels having at least one signature receiving compartment which is adapted to receive a plurality of signatures therein to form an assembly of such signatures carried by the respective said impeller wheel;

conveying means operable to convey such a plurality of signatures selectively to the said at least one compartment of either of said impeller wheels;

receiving means for receiving such assemblies of signatures from said compartments;

means cooperable with said impeller wheels to remove such assemblies of signatures from the respective said compartments and to direct such assemblies of signatures to said receiving means; and said impeller wheels being cooperable, by virtue of their said rotation in counter-revolutionary fashion, to orient such assemblies of signatures with respect to said receiving means in a manner that the assemblies of signatures directed to said receiving means from one of said impeller wheels are inverted with respect to those directed to said receiving means from the other of said impeller wheels.

2. The apparatus as set forth in claim 1 additionally including means for delivering a serial plurality of such signatures at a selected speed of travel to said conveying means.

3. The apparatus as set forth in claim 2 wherein said conveying means includes a pair of belt conveyer means for directing such signatures to said compartments of said pair of impeller wheels, respectively.

4. The apparatus as set forth in claim 3 additionally including directing means for directing such signatures selectively to one or the other of said pair of belt conveyer means.

5. The apparatus as set forth in claim 4 wherein each said conveyer belt means includes first and second belt conveyers which operate to convey such signatures at differing speeds of travel.

6. The apparatus as set forth in claim 5 wherein one of said first and second belt conveyers is operable to convey such signatures at a conveying speed greater than the speed of travel thereof in said delivering means, and the other of said first and second belt conveyers is operable to convey such signatures at a conveying speed less than the conveying speed of said one of said belt conveyers.

7. The apparatus as set forth in claim 6 wherein said first and second belt conveyers are respective upper and lower double belt conveyers, the said upper belt conveyer means being operable at a belt speed greater than the belt speed of said lower belt conveyer means.

8. In an apparatus adapted to be driven in an assembly cycle for receiving signatures that are transversely cut by a cutting device from a continuous band which travels in a path of travel including a vertically directed, generally planer path portion that extends downwardly from such a cutting device, and for assembling such signatures into partial inner books and depositing such partial inner books, the combination comprising:

a pair of essentially identical impeller wheels disposed horizontally adjacent one another on respective, mutually parallel central axes and positioned symmetrically about such a planer path portion for rotary movement on said central axes, respectively, with circumferential portions of said impeller wheels in mutually confronting relation;

conveyor means located intermediate said impeller wheels and generally below said circumferential portions to receive such partial inner books thereon;

means for driving said impeller wheels synchronically with such an assembly cycle in rotation about said central axes, respectively, at a common, uniform rotary speed and in mutually opposed directions of rotation;

each said impeller wheel having a hub portion and a plurality of circumferentially distributed, radially extending vanes pivotally carried with respect to said hub portion on respective pivot axes extending parallel to the respective said central axes;

said vanes forming a respective plurality of input compartments which are distributed circumferentially about each said impeller wheel and are adapted to receive such signatures therein for assembly of such partial inner books within said input compartments and for ejection of completed ones of such partial inner books from said input compartments onto said conveyor means;

said vanes being pivotally moveable about said pivot axes, respectively, with respect to said impeller wheels, respectively;

means operable to control the pivotal movement of said vanes with respect to said impeller wheels, respectively, such that during a complete rotation of each said vane with the respective said impeller wheel the rotary movement of said vane is controlled periodically to include a phase of slow rotary movement of said vane while traversing a first portion of such an assembly cycle proceeding from an initial input position and subsequently a phase of quicker rotary movement of said vane while traversing a second portion of such an assembly cycle proceeding to an output position, followed by further rotary movement of said vane while further traversing such an assembly cycle back to said initial input position;

the respective said input compartments corresponding to the said vanes traversing said second portion of such an assembly cycle being located generally in said mutually confronting relation transversely intermediate said impeller wheels and directly above said conveyor means with the respective said input compartments of one said impeller wheel being in circumferentially offset relation with respect to the respective said input compartments of the other said impeller wheel;

adjustable tongue means located adjacent such a planer path portion intermediate such a transverse cutting device and said impeller wheels and moveable to direct ones of said signatures selectively toward one of said input compartments of said one or said other impeller wheel located adjacent said initial input position;

double conveyor means located intermediate said tongue means and said impeller wheels to convey said ones of said signatures from said tongue means selectively to said one or said other impeller wheel;

means for moving said tongue means synchronically with said assembly cycle to direct said signatures to said input compartments adjacent said initial input position; and said conveyor means being operable to remain stationary during deposit of ones of such partial inner books thereon and being further operable to convey such partial inner books deposited thereon away from said impeller wheels in a direction parallel to said central axes.

9. The apparatus as set forth in claim 8 wherein said double conveyor means includes two double belt conveyors, each comprised of a pair of double belt conveyors serially arranged as an upper and a lower double belt conveyor with each said upper double belt conveyor being operable to move at a belt speed marginally faster than such signatures traveling from said tongue means and each respective lower double belt conveyor being operable to move at a belt speed approximately ½ the belt speed of the respective said upper double belt conveyor such that a progressive slowing of signature speed is achieved as such signatures are conveyed by said upper and lower double belt conveyors, respectively, to produce an overlapping of the respective signatures.

10. The apparatus as set forth in claim 1 further including guide means cooperable with said vanes while traversing said second portion of such an assembly cycle to guide such partial inner books onto said conveyor means.

* * * * *